US005542277A

United States Patent [19]

Dunwoody

[11] Patent Number: 5,542,277

[45] Date of Patent: Aug. 6, 1996

[54] APPARATUS FOR STRIPPING A DRAWN ARTICLE FROM A PUNCH

[75] Inventor: Paul R. Dunwoody, Oxfordshire, United Kingdom

[73] Assignee: Carnaudmetalbox PLC, England

[21] Appl. No.: 367,214

[22] PCT Filed: Jun. 28, 1993

[86] PCT No.: PCT/GB93/01348

§ 371 Date: Jan. 10, 1995

§ 102(e) Date: Jan. 10, 1995

[87] PCT Pub. No.: WO94/02266

PCT Pub. Date: Feb. 3, 1994

[30] Foreign Application Priority Data

Jul. 21, 1992 [GB] United Kingdom ..... 9215433

[51] Int. Cl.[6] ..... B21D 45/00; B21D 45/06

[52] U.S. Cl. ..... 72/345; 72/344; 72/427

[58] Field of Search ..... 72/344, 345, 349, 72/379.4, 427

[56] References Cited

U.S. PATENT DOCUMENTS 4,343,173 8/1982 Bulso, Jr. et al. ..... 72/344

5,056,350 10/1991 Moen et al. ..... 72/345

5,249,449 10/1993 Lee et al. ..... 72/352

*Primary Examiner*—Lowell A. Larson

*Assistant Examiner*—Rodney Butler

*Attorney, Agent, or Firm*—Diller, Ramik & Wight, P.C.

[57] ABSTRACT

In a press comprising at least one die (3), a hollow punch (1) and ram (2) assembly movable through the die, and a bottom forming tool (13) having a convex surface portion (14) axially aligned with the punch, said punch and ram assembly having a valve seat (24) in the ram hollow and a valve member (21) which has a valve body engageable with the valve seat and a stem extending through the valve seat towards the free end of the punch so that as the punch approaches the convex surface portion of the bottom forming took, the valve member is lifted off the valve seat to permit compressed air to pass from the punch hollow, the valve stem is supported in a bearing between the valve seat and the extremity of the punch, and said valve stem and interior surface of the punch define a cavity of prechosen volume between the valve seat (24) and extremity of the punch (1) so that as the punch approaches the bottom forming tool (5) cooperation of the convex surface portion (14) of the bottom forming tool and valve stem (20) lifts the valve body of the valve seat to permit compressed air to fill the cavity with a prechosen volume of compressed air before inertia forces close the valve again on the return stroke.

17 Claims, 4 Drawing Sheets

APPARATUS FOR STRIPPING A DRAWN ARTICLE FROM A PUNCH

This invention relates to the removal of an article, formed from a metal disc by cooperation of a punch and die, from the punch and more particularly, but not exclusively to the removal of a drawn and wall ironed can body from the hollow punch of a press tool having a bottom shaping tool axially aligned with the punch.

In the mass production of cans from blanks cut from sheet metal, a cup is formed by a blank and draw tool and the cup is then redrawn and wall ironed in a long stroke press comprising a punch carried on a ram which drives the punch through a redraw die and a sequence of ironing rings making progressively smaller clearance with the punch so the can produced has a bottom wall substantially the same thickness of the sheet metal and side wall thinner than the bottom wall. One such wall ironing press is described in British Patent 1463026 (STANDUN) in which it is said that the ram moves at a rate in the order of 150 to 175 strokes per minute. This press used a mechanical stripper comprising a plurality of fingers arranged to surround the punch/ram so that on the return stroke the eared edge of the side wall of the can body strikes the stripper fingers which, after limited deflection to make complete contact with eared profile, lock to prevent the can body travelling back through the ironing rings as the ram retracts. GB-A-2181685 (METAL BOX) describes another form of stripper having deflectable fingers to engage with the eared edge. Whilst these deflectable finger strippers have been satisfactory at stroking rates of the order of 150 strokes per minute (roughly equivalent to linear speeds of about 180 meters per minute) improved processes having increased stroking rates of about 280 strokes per minute and greater are being introduced. At these increased speeds the free edge of the can strikes the stripper fingers at increased speeds which crumple the free edge.

Hollow rams and punches are customarily used so that the can interior is vented by air introduced through the punch during stripping. Various forms of knock out pad in the punch hollow have been proposed, such as are described in U.S. Pat. No. 3,402,591 (MAEDER) and U.S. Pat. No. 3,524,338 (BOZEK) but these knock out pads require a long actuating rod extending through the punch so adding mass to the ram and punch assembly and the complication of a mechanism to operate them.

In order to reduce the moving mass of the ram and punch assembly, punches have been proposed which rely on compressed air delivered through the ram hollow to not only vent but also push the completed can off the punch. In U.S. Pat. No. 3,771,344 WRIGHT/Crown Cork & Seal Co) and U.S. Pat. No. 4,164,860 (KAMINSKAS/Standun Inc) compressed air delivered through the ram assembly assists an external mechanical stripper.

U.S. Pat. No. 3,771,344 describes an assembly of dies, a ram and punch assembly movable through the dies and a doming pad in axial alignment with the end of the punch so that a concave dome is formed on the can bottom at the end of the ram stroke. The punch is provided with concentric passage ways which meet at a valve seat openable and closable by a valve having a dependent stem. The outer passage way is filled with compressed air at high pressure used for stripping and the inner passage way is filled with compressed air lower pressure to bias the valve to close on the valve seat. As the punch approaches the doming pad and flat can bottom is deformed to concave and presses on the valve stem to open the valve so that air at 100 psi is delivered to the interior of the can to vent and assist stripping during the return stroke. As the can leaves the punch, the valve is closed by the air pressure from the inner passage way so that no air is wasted during the return stroke. Bowever provision of the concentric passages for high pressure and low pressure air is a costly complication to the punch.

In U.S. Pat. No. 4,164,860 it is observed that although use of low air pressure in Wright's punch minimises risk of the stripping air blasting the freed can against the doming pad, the valve closes so quickly that there is not sufficient air entering the can to maintain a stripping force. Accordingly, U.S. Pat. No. 4,164,860 proposes a punch into which compressed air is delivered continuously. The problem of excessive air pressure blasting the freed can against the doming pad is overcome by provision of a radial partition defining an orifice within the bore of the punch at a distance from the free end of the punch so that the punch bore, partition and can on the punch define a chosen volume, which is charged with a volume of compressed air sufficient to assist stripping and maintain a positive pressure in the can until it is freed, but insufficient to project it violently towards the doming pad. In a preferred embodiment the punch has a second constriction in the form of a flap valve located between the "first constriction" or radial partition and the end of the punch. This flap valve closes as the bottom wall of the can is domed to reduce the air volume in the punch so limiting the volume of excessively pressurised air in the chosen volume. This preferred arrangement is said to give high pressure at commencement of stripping and gentle abatement during progressive stripping by both an external finger stripper and the air assistance to stripping. However, it appears that compressed air is wasted on the return stroke.

U.S. Pat. No. 5,056,350 (MOEN/COORS BREWING CO) describes apparatus for stripping a drawn can, having an end wall and a side wall upstanding from the periphery of the side wall, from a hollow punch as the punch retracts from a tool which forms a concave dome in the end wall. The punch is supported on a hollow ram having a stepped bore of wider internal diameter at its free end. The punch has a stepped bore which permits fitting around the free end of the ram. The punch is held on the ram by an annular valve body 42 which comprises a cylindrical head and a threaded shank inside the ram so that the head holds the punch on the ram and also seals the valve body to the ram. The valve body 42 has a stepped bore comprising a wide cylindrical surface at the open end of the punch, a tapered valve seat at the other end of the shank and a bushed passage way connecting the valve seat to the cylindrical surface. A valve poppet has a piston portion fitted in the wide cylindrical surface of the body, a hollow stem portion passing through the bushed body passage and a valve head engageable with the valve seat. The piston is preferably urged forward by a spring to close the valve head on the valve seat.

The piston has an end surface comprising a concave central panel surrounded by a frustoconical surface which defines with the interior surface of the punch and end wall of the valve body, an annular cavity 22. When the can body on the punch reaches the doming tool, the end wall of the can is forced into the hollow punch where it causes the piston portion of the valve poppet to move into the wider cylindrical surface of the valve body while the stem portion lifts the poppet head of the valve seat to permit compressed air to pass from the hollow mandrel, through the valve to the cavity 22 defined by the end wall of the can, the punch interior, valve body face and convex end of the valve piston. A cylindrical void, into which the piston portion is pushed, is vented to atmosphere so a limited volume of air, in the cavity 22 and valve stem is available for stripping when the valve closes as stripping commences.

Furthermore the volume of cavity 22 is much reduced by the dome formed in the end wall of the can body so that the volume of air contained in the cavity 22 and valve stem, when the punch retracts and valve closes may not be sufficient to fully fill and strip the can from the punch unless inconveniently high pressure is used. These problems are aggravated as presses are improved to run at greater stroking speeds because the periods of time in which the valve is open to fill the cavity is reduced and the time to strip and can is also reduced.

A further problem arises because the pressure of air arriving from the ram abates as it enters the wider space around the valve head to pass into the hollow stem to the annular cavity 22 so that the air pressure between the can and valve may be less than the supply pressure.

One objective of this invention is to provide apparatus for stripping a drawn can from a hollow punch, after the can strikes a tool axially aligned with the punch to shape the end wall of the can, by means of controlled air pressure derived from a chosen volume of compressed air between a valve in the punch assembly and the can interior.

Another objective is to control the air pressure used to strip the can from the punch, to avoid excessive air pressure that would cause the stripped can to strike the shaping tool at risk of damage to the can body, or cause permanent deformation of the can bottom profile.

A further objective is to provide means to modify the prechosen volume of the cavity to be suitable for the various heights of can that may be made with a change of punch and dies.

In view of the disadvantages identified above in respect of the prior art stripping devices, this invention seeks to fulfill the following further objectives:

(a) provision of stripping means using a controlled volume of compressed air in the punch;

(b) automatic actuation of the stripper as the punch approaches the bottom doming station;

(c) stripping of cans made from a range of common packaging materials including blackplate, tinplate, electro chrome coated steel (ECCS), aluminium alloy, and laminates of these metals with polymeric film, without damage to the cans; and preferably, but not neccessarily, (d) stripping by the air pressure alone without use of external stripping means; and if required (e) a punch adaptable by replacement of simple change parts to serve a range of can heights on a given punch diameter.

Accordingly, this invention provides a press comprising at least one die, a hollow punch and ram assembly movable through the die, and a bottom forming tool having a convex surface portion axially aligned with the punch, said punch and ram assembly having a valve seat in the ram hollow and a valve member which has a valve body engageable with the valve seat and a stem extending through the valve seat through a bearing to a pad at the free end of the punch so that as the punch approaches the convex surface portion of the bottom forming tool the valve pad is pushed to lift the valve body off the valve seat to permit compressed air to pass from the punch hollow, characterised in that said valve stem and interior surfaces of the punch and can define a cavity of prechosen volume surrounding the valve stem between the valve seat and the bearing so that as the punch approaches the bottom forming tool cooperation of the convex surface portion of the bottom forming tool and valve pad lifts the valve body off the valve seat to permit compressed air to fill the cavity with a prechosen volume of compressed air, and as the punch is retracted from the bottom forming tool, and the can starts to strip, the valve body closes on the valve seat so that stripping of a can body from the punch is effected by expansion of air from the cavity.

The distance between the bearing and the valve seat may be defined by a tubular liner defining the interior surface of the ram.

In a further embodiment, the valve stem is tubular, open at an end adjacent the extremity of the punch and has at least one aperture to permit passage of compressed air from the cavity though the stem to the extremity of the punch. If desired the valve stem has a head portion having a concave surface portion complimentary to the convex surface portion of the bottom forming tool. The head of a screw protruding from the surface of the valve stem may be used to prevent the stem passing though the bearing member in the event of breakage of the valve member.

In the preferred embodiment, the valve member has a second stem which extends from the valve body though a second bearing which has passageways to permit passage of compressed air from the rest of the ram to the valve seat. The distance between the valve seat and the second bearing may be defined by the length of a tubular spacer. A further spacer defines a distance from the second bearing to a step in the hollow of the ram, or to the end of the ram.

If desired, the assembly of spacers and valve seat may include an elastic member which exerts an axial thrust to the assembly.

The press according to this invention may be used without an external stripping mechanism surrounding the punch but may also, if desired, be used to assist a mechanical stripper.

If desired the bottom doming station may include passageways to direct compressed air towards the punch.

Various embodiments will now be described by way of example and with reference to the accompanying drawings in which.

Figure 1:
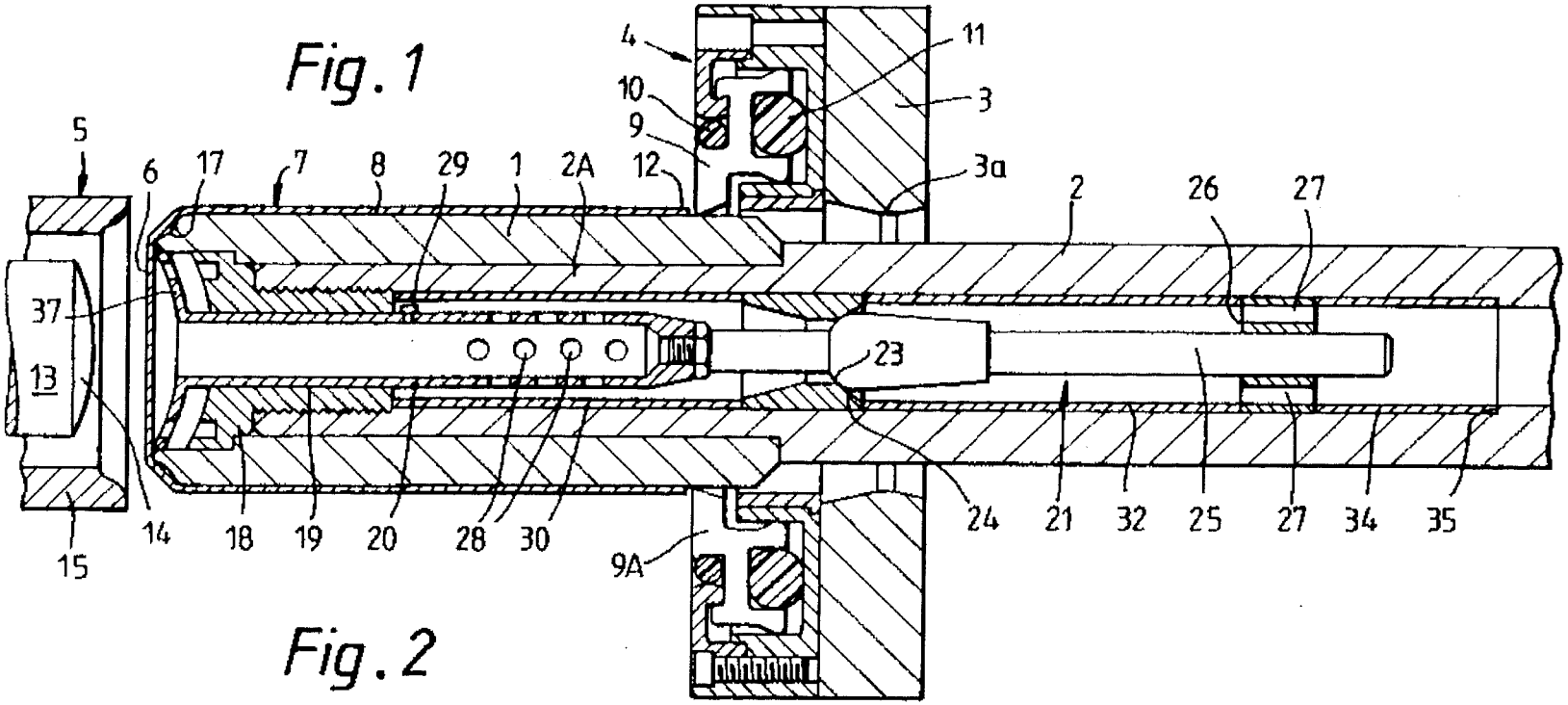
FIG. 1 is a sectioned side view of a punch and ram, incorporating features of this invention, during the forward stroke of the press.
Figure 2:
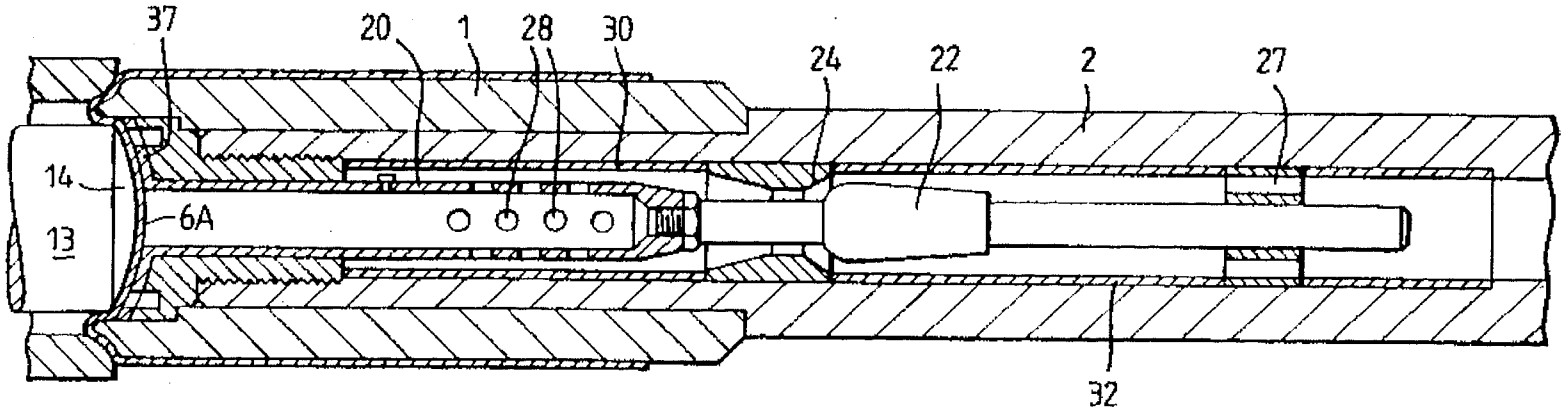
FIG. 2 is a sectioned side view of the punch and ram and bottom forming tool after forming of a can bottom.

FIG. 1 shows a punch 1 supported on a ram 2 passing through a die 3, and an optional mechanical stripper 4, during a forward stroke towards a bottom forming station 5 at which the bottom wall 6 a drawn can body 7 will be formed to the shape 6A shown in FIG. 2. In some of our experiments to develop the design of punch, a mechanical stripper was provided to make sure the cans were removed from the punch and prevent any risk of damage to the press. The stripper shown in FIG. 1, used when carrying out tests on tinplate cans, is fully described in GB 2181685 A to which the reader is directed for full information. However, other mechanical strippers similar to that described in GB 1547539, were used when producing cans from aluminium alloy and polymer laminates.

In FIG. 1, the die 3 is the last wall ironing die in a series of three wall ironing dies each die making a clearance between a land (such as that denoted 3*a* in FIG. 1) and the punch 1, to progressively reduce the thickness of the side wall 8 of the can body 7. For clarity, the other dies are not shown.

The external mechanical stripper 4 is of a kind comprising a plurality of segments 9, 9A arranged around the punch and held towards it by a resilient ring 10. Each segment is supported for a pendulum like motion at the segment tip against a resilient buffer ring 11 so that each segment can yield to fit against an eared free edge of the ironed side wall during the return stoke. As shown in FIG. 1 the segments are in position to act against the can edge 12 during the return stroke.

The bottom forming tool comprises a pad 13 having a convex surface 14 axially aligned with the end of the punch 1. As shown in FIG. 1, the bottom forming tool also includes an optional annular tool 15 having a convex surface 16 which cooperates with a complimentary concave annulus 17 on the punch 1 to shape a stacking bead around the can bottom and to apply a frictional force to suppress wrinkling of the can bottom profile during forming. A passage way between the pad 13 and annular tool 15 may be used to deliver compressed air, the purpose of which will be described later.

The punch 1 surrounds a ram portion 2A of reduced diameter and may be fixed to the ram by shrink fitting. However, in FIG. 1 the punch has a stepped bore so that a bearing block 18 having a stepped surface is arranged to hold the punch sleeve 1 against a step in the exterior of the ram 2. The bearing block 18 is held in the hollow of the ram by screw threads in the ram and block. The block has a central bore which may be bushed to act as a linear bearing 19 for the valve stem 20 of a valve member 21.

The valve member 21 comprises the hollow stem 20 having side holes 28, a valve body 22 having an arcuate or conical sealing surface 23 for engagement with a complimentary surface of a valve seat 24, and a second stem 25 extending further into the ram hollow where it is supported by a second linear bearing 26 in the ram. This second linear bearing 26 has a plurality of apertures 27 to permit compressed air to pass though it freely.

The valve seat 24 comprises the annular sealing surface of arcuate or conical cross section, a throat and a divergent exit surface to encourage free flow of compressed air when open.

The distance between the first bearing block 18 and valve seat is controlled by the length of a tubular spacer 30. The length of this spacer 30 is chosen to ensure that the cavity between the valve seat 24 and punch extremity will contain a volume of compressed air at pressure sufficient to ensure that a can 7 on the punch will leave the punch without development of a partial vacuum that would cause the side wall 8 of the can to collapse.

A second tubular spacer 32 separates the valve seat 24 from the second linear bearing 26. A third tubular spacer holds the second linear bearing 26 at a distance from a step 35 in the bore of the ram to ensure clearance in the axial direction for motion of the valve 21 in its bearings 18 and 26.

In FIG. 1, it will be seen that the hollow valve stem 20 terminates in a dished pad 37 having a concave surface complimentary to the convexity of the convex surface 14 of the pad of the bottom forming tool. Our early work with a simple tubular stem 20, was successful in stripping of cans from the punch 1 but produced damage on the interior surface of the bottom wall of each can. The dished pad prevents this damage and so it is preferable to have this dished pad. A further refinement is provision of a screw having a head 29 protruding from the tubular stem 20 to prevent the stem passing through the bearing block 18 in the event of any fracture of the valve member. It will be understood from FIG. 2 that the domed panel 6A of the can bottom is formed by relative motion between the annular end of the punch 1 and convex surface portion 14 of the bottom forming tool 5 so that the dished pad 37 need not necessarily be compressed between the bearing block 18 and domed panel 6A. However, it will be noticed in FIG. 1 that the back of the dished pad has a surface complimentary to the end surface of the bearing block 18, in order that the depth or shape of the can bottom profile may be controlled by the back of the dished pad 37 contacting the end surface of the bearing block 18 and causing the bottom forming pad 13 to be moved together with the punch once the required depth has been achieved, and also in order to avoid excessive motion of the valve away from the valve seat.

As the punch and ram assembly (1, 2) reaches the bottom forming station 5, an inclined annulus of can body material is restrained between the concave annulus 17 of the punch 1 and an end surface of the annular tool 15 which is resiliently supported, (by means not shown), so that further progress of the punch pushes the can bottom 6 against the convex surface 14 to form a bottom profile 6A free of wrinkles as shown in FIG. 2.

As the outwardly concave dome 6A develops it strikes the valve pad 37 so experiencing an inertia force arising from the mass of valve member 21 and air pressure on it. Continued devlopment of the "dome" 6A pushes the pad 37 into the ram to lift the valve body 22 from the valve seat 24 so permitting compressed air to pass through the spacer 34, the second bearing apertures 27, the spacer 32, the valve seat 24, spacer 30, holes 28, and valve stem 20 so that the interior of the can body becomes pressurised.

As shown in FIG. 2, further forward stroke of the punch and ram assembly 1, 2 causes the bottom wall 6A of the can body to push the pad 37 to abutt the end wall of the bearing 18 so that the completed bottom profile 6A is supported on one side by pad 37 and concave annulus 17 and on the other side by the convex tool surface 14 and annular tool 15.

It is generally desirable for the can body to remain supported during stripping by the annular tool 15 which rises during return stroke. This is possible because initial stripping is driven by the inertia force to move the valve member 21 and full pressure of air in the ram. Provided the exterior surface of the bottom wall of the can remains supported by the bottom forming tool, air pressures in the ram may, if desired, be used that exceed the pressure at which an unsupported can end would be distorted.

Figure 3:
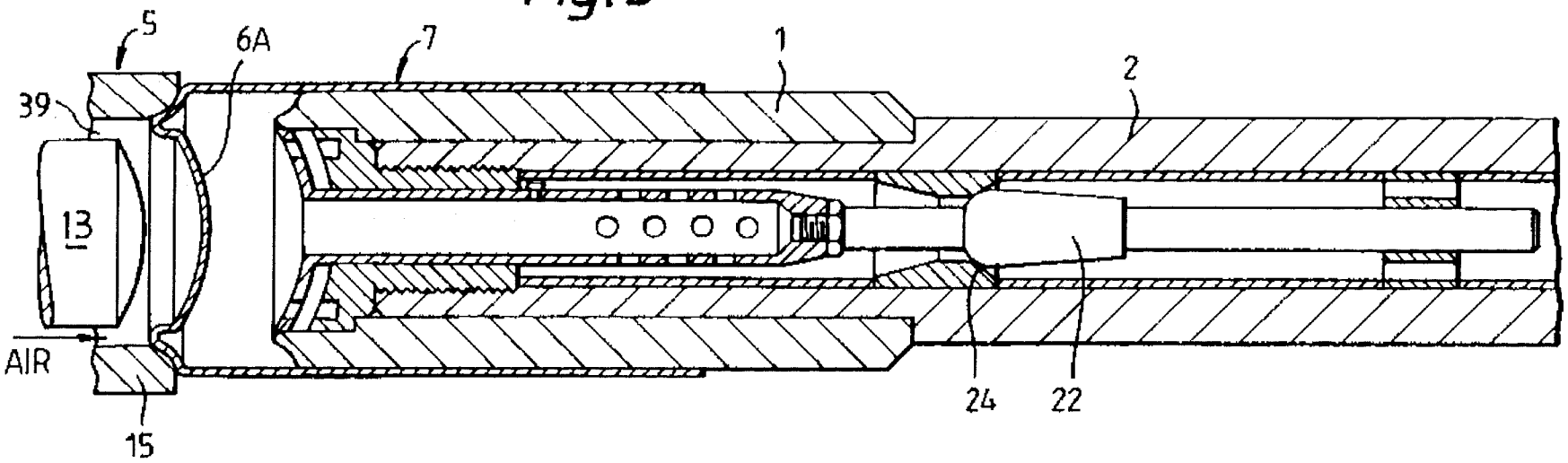
FIG. 3 is a sectioned side view of the punch ram and bottom forming tool during the return stroke of the punch as stripping of the can proceeds.

FIG. 3 shows the punch 1 and ram 2 assembly during the return stroke away from the bottom forming tool 5. Air pressure delivered from the ram has filled the cavity. As the can starts to strip, the valve member 21 is able to move forward. Due to the reciprocal motion of the ram 1 and inertia of the valve member 21, the valve body 22 closes against the seat 24 without need for any spring or similar device. Once the valve has been closed in this way, the differential pressure across the valve seat overcomes the opposite inertia forces at the opposite part of the cycle keeping the valve closed until the next can has its base profile formed. Thus when the can starts to strip, no more air is allowed past the valve into the chamber. The can body 7 is being urged to leave the ram by the volume of compressed air trapped in the cavity and can body at the time the valve closed.

Air is fed through the ram at about 80 psi so that, at the time of closing the valve, the cavity contains air at 80 psi. When stripping a 33 cl aluminium can, the cavity volume was 15 cl and the pressure was 80 psi. Other cavity volume and air pressure combinations may be chosen provided that, as the can leaves the punch, it contains at least a small positive pressure (about 10 psi) to urge it to clear the punch and prevent any risk of collapse of the side wall of the can. During experiments, 33 cl beverage cans drawn and wall ironed from aluminium alloy have been successfully stripped without use of a mechanical stripper.

Excessive residual pressure in the can as it leaves the punch may cause the can to be projected towards the bottom forming tool. Risk of damage arising from impact of the can with the bottom forming tool may, if desired be reduced by directing compressed air, or other fluid, from passage ways 39, between the pad 13 and annular tool 15, to oppose progress of the stripped can body. Air from passageways 39 may be used to eject the stripped can body from the bottom tool.

The beverage can bottom 6A shown in FIGS. 2 and 3 is designed to withstand internal pressures up to 6 or 7 bar. Higher pressures in the ram 2 may be used for stripping provided the can bottom 6A is externally supported during stripping. As shown in FIG. 3 part of the can bottom is supported in the annular tool 15 of the bottom forming tool during stripping. Also as shown in FIG. 3, delivery of compressed air from the bottom tool 5 provides additional support to the can bottom while it is being stripped so that even higher pressures may be used in the ram to reduce the need for a mechanical stripper.

Figure 4:
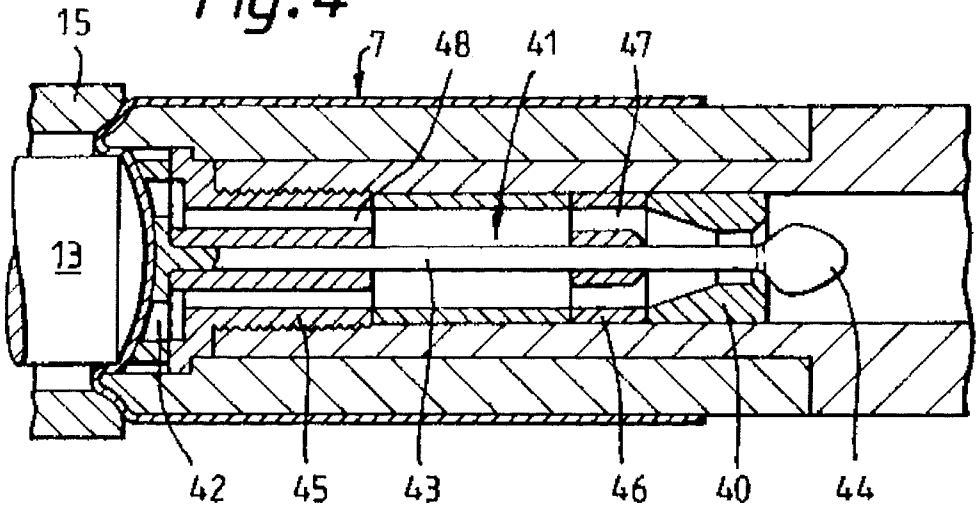
FIG. 4 is a sectioned side view of a second embodiment of the punch and ram.

FIG. 4 shows a second embodiment comprising a valve seat 40 and a valve member 41 in which the valve member has a dished pad 42, a solid stem 43, and a bulbous valve body 44. The solid valve stem 43 is supported by a first bearing block 45, which has passage ways 48 and a dished end surface permit passage of air and a second bearing 46 adjacent the valve seat. The second bearing also has passageways 47 to permit a free flow of compressed air through it. A benefit arising from this arrangement is that the valve member is shorter, and therefore, lighter so that inertia forces arising from the valve motion are less than those arising in the other embodiment. This alternative embodiment acts in a similar manner to that of the first embodiment.

Figure 5:
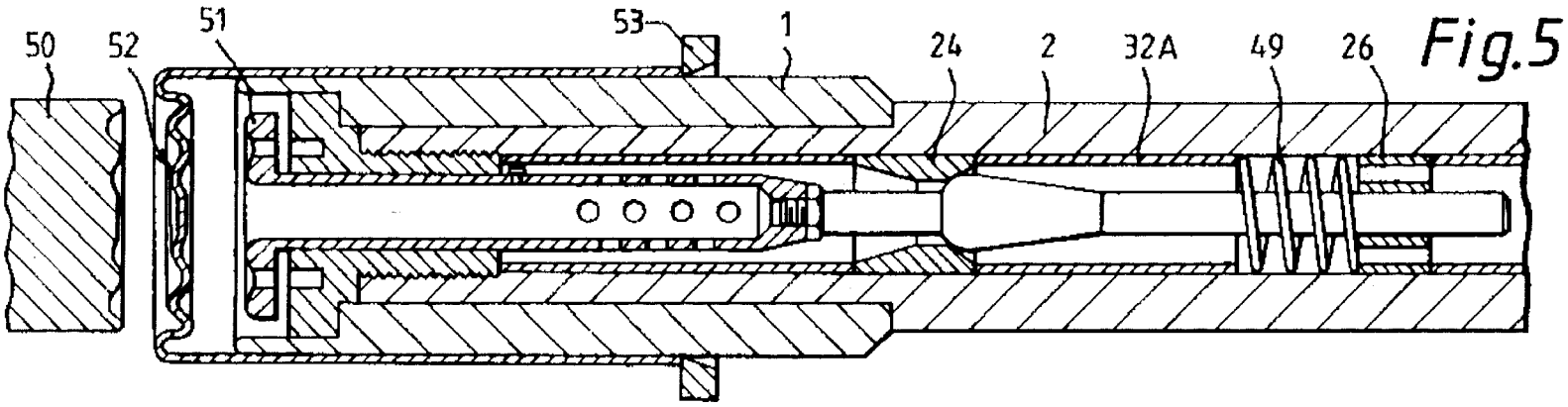
FIG. 5 is a sectioned side view of a third embodiment of the punch ram and bottom forming tool.

FIG. 5 shows a punch 1 and ram 2 assembly, arranged to cooperate with a bottom forming tool 50 to form the flat bottom of a drawn can body to a bottom wall 52 having a flat centre panel surrounded by annular expansion beads connected to the side wall by an annular channel portion which holds the centre panel and expansion beads within the side wall of the can body to define a generally outwardly concave bottom wall.

FIG. 5 shows the can during stripping after cooperation of the convex annular ribs of the bottom forming tool 50 and complimentary surfaces of a valve stem pad 51 with the nose of the punch 1 have already formed the can bottom and inertia forces on the return stroke have closed the valve body on the valve seat so that the can body is being stripped by air pressure contained in the cavity and can body as already described. It will be noticed that the can body has already started to leave the punch as the side wall has struck a mechanical stripper 53.

In FIG. 5, a spring 49 is located between the second bearing 26 and a shorter spacer 32A located between the valve seat 24 and second bearing 26. The benefit of incorporation of this helical spring 49, or like functioning resilient member is that it ensures that the spacers and valve seat are securely held in position without recourse to precision machining of the spacers and valve seat.

The spring or elastic member may alternatively be located at other positions in the sequence of spacers, valve seat, second bearing and step in the ram surface, so long as it applies an axial thrust to the assembly.

It will be noticed that, in the embodiments described, the surfaces defining the passage ways for compressed air are not obstructed by undue bends or contrictions so that the cavity and entry zone before the valve body fill rapidly when the valve is open.

Also the volume of air within the ram upstream of the valve seat 24 is preferred to be large relative to the cavity volume in order to provide a copious reservoir to ensure sufficient supply of air.

It will be appreciated that use of relatively high pressures of compressed air give rise to some strain of the side wall of the can body so relieving the frictional fit of the side wall of the punch. This elastic strain is particularly useful when stripping cans that have a relatively thick annulus at their free edge.

It is customary to use a punch of given diameter, typically 65 mm, to make cans of various heights. An advantage of the present invention is that by replacing the valve member, valve seat and spacers, the punch and ram may be conveniently adapted to a suitable cavity volume to strip the can being made.

Whilst it is generally desirable to avoid distortion of the bottom profile, as has been discussed with reference to FIG. 2, there are occasions when distorsion can be put to good use. For example, the valve pad may be designed to impart inertia force from the valve member to certain portions of the can bottom so as to reform such portions in a manner which would improve the strength of the finished can bottom profile, or so as to impart a desired marking, such as a manufacturing code.

Figure 6:
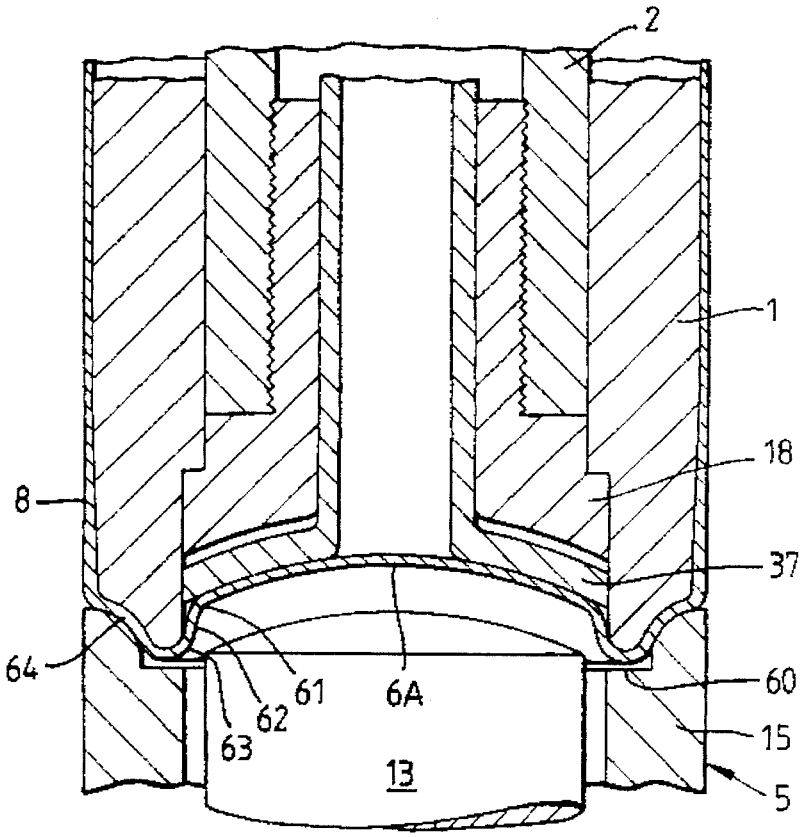
FIGS. 6 and 7 are enlarged fragmentary sections a fourth embodiment of the punch and ram assembly at the bottom forming tool.

FIG. 6 shows the punch and ram assembly during the return stoke so that the shaped bottom profile 6A is still clamped between the punch surface 17 and rising annular tool 15 of the bottom forming station 5. The pad 37 of the valve member, acted on by inertia force arising from the return stroke of the punch, is pressing the can bottom profile towards a flat ledge 60 in the annular tool. At this stage, the can bottom profile 6A has a first radius portion 61 which joins the centre domed panel to a frustoconical annulus 62, and a second radius portion 63 which joins the frustoconical portion 62 to the side wall 8 via a stacking bead 64. During this stage in the return stroke of the punch, the can bottom profile has left the pad 13 of the bottom forming tool and the pad 37 of the valve member has left the end wall of bearing 18.

Figure 7:
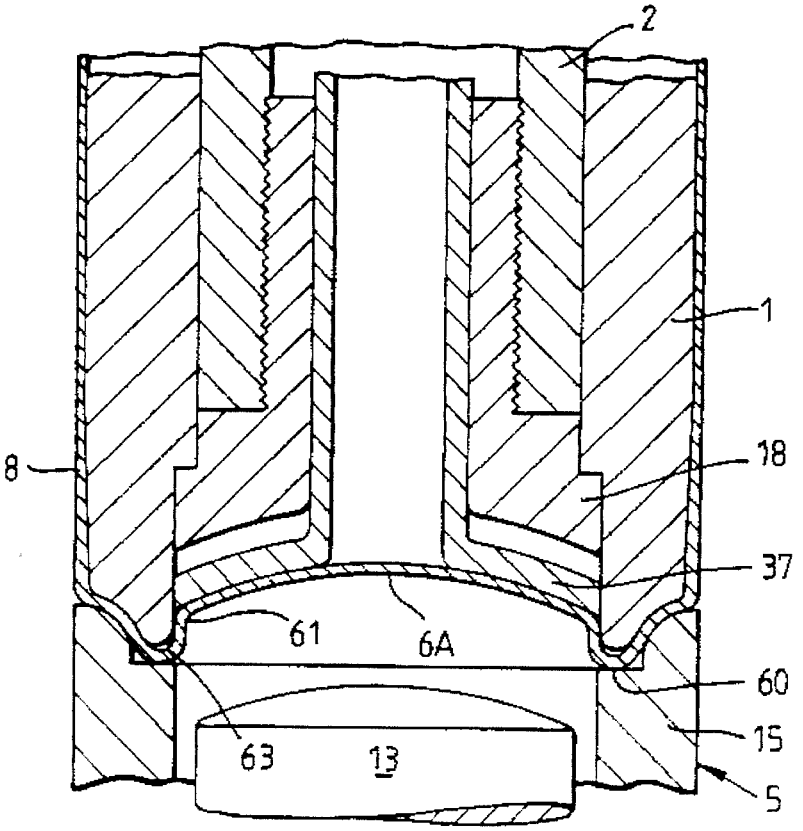

FIG. 7 shows that inertia force delivered by pad 37 of the valve member acting on the profile 6A has caused the radius 61 to tighten and the second radius portion 63 to also tighten away from the punch nose so that the frustoconical wall is displaced towards the interior cylindrical surface of the punch. Tightening of radius portion 63 will particularly improve the ability of the can bottom profile to resist internal pressure.

Other uses for the inertia force available from the valve member as it closes include marking of an identification code on the can bottom, if desired.

Figure 8:
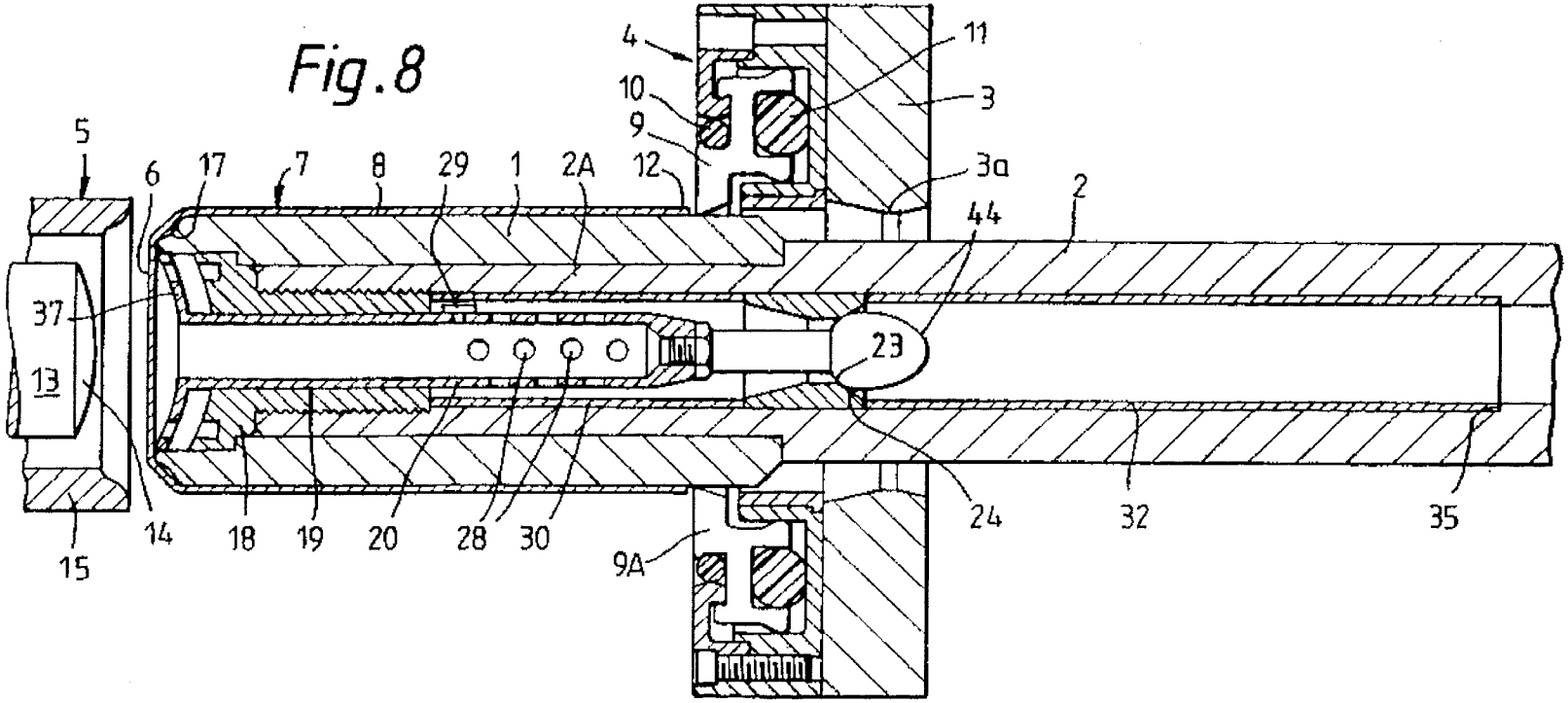
FIG. 8 is a sectioned side view of fourth embodiment of the punch and ram.

FIG. 8 shows a modified form of the punch and ram shown in FIG. 1 so that like functioning parts are denoted by the same part number. However, in FIG. 8 the valve member 21A comprises the dished pad 37, the hollow stem 20 with side holes 28, a bulbous body 44 for engagement with the valve seat 24. The hollow stem is supported in a somewhat longer bearing block 18. Advantages arising from thus modified arrangement are that the valve member is lighter to minimise inertia forces and alignment of two bearings is avoided. Thus modified valve works in the same manner as the embodiment shown in FIG. 1.

I claim:

1. A press comprising at least one die, a hollow punch and a hollow ram defining a hollow punch and ram assembly movable through the die, a bottom forming tool having a convex surface portion axially aligned with the punch, a valve seat in the hollow punch and ram assembly and a valve member which has a valve body engageable with the valve seat, a stem extending through the valve seat through a bearing, a pad at a free end of the stem near an end of the punch so that as the punch approaches the convex surface portion of the bottom forming tool, the pad is pushed to lift the valve body off the valve seat to permit compressed air to pass from the hollow punch, said bearing supports the valve member adjacent the pad at the stem free end, said valve seat being located remote from the bearing to define a cavity located at least between the valve seat and the bearing, and said cavity including an annular space surrounding the valve stem within the hollow ram whereby as the punch approaches the bottom forming tool cooperation of the convex surface portion of the bottom forming tool and the pad lifts the valve body off the valve seat to permit compressed air to fill the cavity with a prechosen volume of compressed air, and as the punch is retracted from the bottom forming tool and the can starts to strip, the valve body closes on the valve seat but stripping of a can body from the punch continues under the effect of expansion of air from the cavity.

2. A press according to claim 1 wherein the distance between the bearing and the valve seat is defined by a tubular liner defining an interior surface of the ram.

3. A press according to claim 1 wherein the valve stem is tubular and is open at an end adjacent the extremity of the punch, and said tubular valve stem has at least one aperture to permit passage of compressed air from the cavity through the tubular valve stem to the extremity of the punch.

4. A press according to claim 1 wherein the valve stem has a head portion having a concave surface portion complimentary to the convex surface portion of the bottom forming tool.

5. A press tool according to claim 1 wherein the head of a screw protrudes from the valve stem to prevent the stem passing through the bearing member.

6. A press tool according to claim 1 wherein the valve member has a second stem which extends from the valve body through a second bearing which has passageways to permit passage of compressed air from the rest of the ram to the valve seat.

7. A press according to claim 1 wherein an external stripping mechanism surrounds the punch.

8. A press according to claim 1 wherein the bottom forming tool includes passageways to direct compressed air towards the punch.

9. The press according to claim 1 wherein said stem is a solid member.

10. The press according to claim 1 wherein said stem is a hollow member.

11. The press according to claim 1 wherein said cavity is defined between said valve seat and said pad.

12. The press according to claim 1 wherein said stem is a hollow member, and aperture means for placing an interior of said hollow member in fluid communication with said cavity.

13. A press according to claim 6 wherein the distance between the valve seat and the second bearing is defined by the length a tubular spacer.

14. A press according to claim 6 wherein a further spacer defines a distance from the second bearing to a step in the hollow ram.

15. A press according to claim 13 wherein an elastic member applies an axial thrust to the tubular spacer and valve seat.

16. A press according to claim 13 wherein a further spacer defines a distance from the second bearing to a step in the hollow ram.

17. A press according to claim 14 wherein an elastic member applies an axial thrust to the tubular spacer and valve seat.

* * * * *